United States Patent [19]

Ortega

[11] 4,154,159

[45] May 15, 1979

[54] APPARATUS FOR STORING AND BALING NEWSPAPERS AND THE LIKE

[76] Inventor: Fredrick Ortega, 14 Insley St., Demarest, N.J. 07627

[21] Appl. No.: 888,927

[22] Filed: Mar. 22, 1978

[51] Int. Cl.[2] ..... B65B 13/02

[52] U.S. Cl. ..... 100/34; 100/99; 211/50

[58] Field of Search ..... 211/50; 100/1, 34, 99, 100/24, 25

[56] References Cited

U.S. PATENT DOCUMENTS

| | | | |
|---|---|---|---|
| 650,494 | 5/1900 | Sooy | 100/24 X |
| 956,387 | 4/1910 | Magson | 100/34 |
| 1,096,356 | 5/1914 | Downey | 100/34 |
| 1,777,694 | 10/1930 | Halteman | 100/34 |
| 2,418,550 | 4/1947 | Edwards | 100/34 X |
| 2,636,432 | 4/1953 | Sherer | 100/34 |
| 2,639,037 | 5/1953 | Friend | 100/34 |
| 2,965,016 | 12/1960 | Price | 100/34 |
| 3,182,586 | 5/1965 | Armington | 100/25 X |
| 3,491,681 | 1/1970 | Saro | 100/34 |
| 3,739,714 | 6/1973 | Howard | 100/34 |

FOREIGN PATENT DOCUMENTS

| | | | |
|---|---|---|---|
| 570299 | 12/1975 | Switzerland | 100/34 |
| 579375 | 9/1976 | Switzerland | 100/34 |

*Primary Examiner*—Billy J. Wilhite

*Attorney, Agent, or Firm*—Robert A. Maikis

[57] ABSTRACT

Apparatus for storing and baling newspapers is provided having an imperforate rectangular shelf supported by vertically-disposed legs which extend beyond the top side of the shelf to form an open-sided container for the stack of newspapers. The shelf top side has a longitudinally-extending groove and three laterally-extending grooves which are adapted to receive a threading rod having a notch at one end thereof. With a stack of newspapers on the shelf, the end of the baling string is held in the notch and is pushed through the grooves, so that one longitudinal tie and either one, two, or three lateral ties may be made for each bale. The legs are secured to the shelf by self-locking connecting means. One of the legs is graduated with a vertically-extending scale expressing the height of the stack of newspapers in terms of the approximate weight of the stack. A magazine storage shelf, a holder for a roll of baling string and a peg for storing the threading rod are also provided.

10 Claims, 7 Drawing Figures

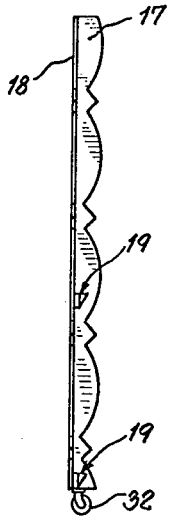
Fig. 3.
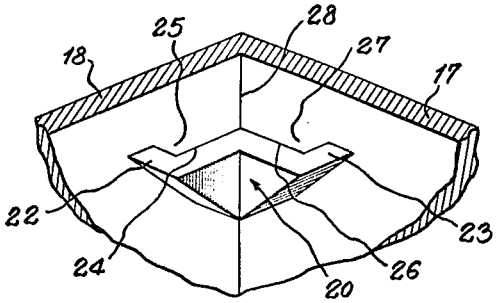
Fig. 4.
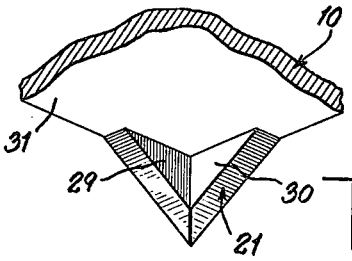
Fig. 5.
Fig. 6.
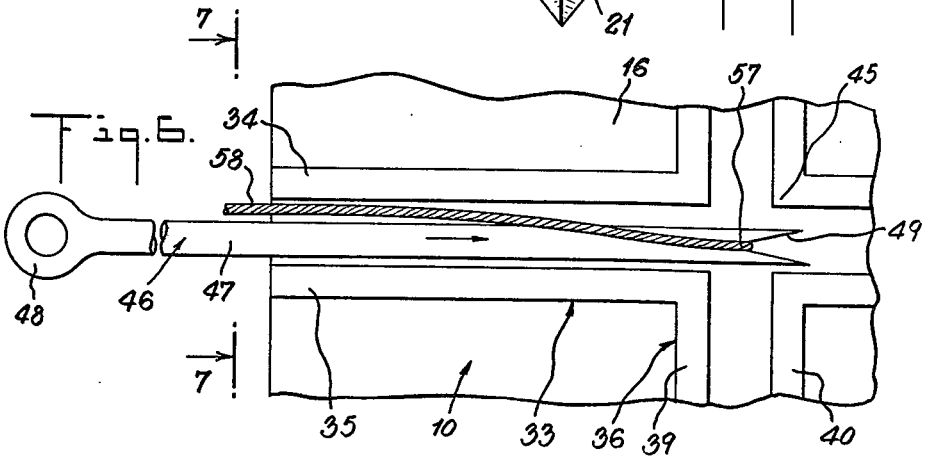
Fig. 7.
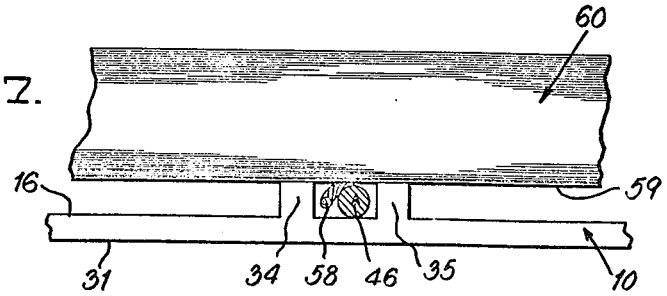

APPARATUS FOR STORING AND BALING NEWSPAPERS AND THE LIKE

BACKGROUND OF THE INVENTION

1. Field of the Invention

This invention relates to apparatus for storing and packaging paper and more particularly to apparatus which not only stores newspapers and the like in a neat stack but which also permits the stack to be baled without the necessity of physically moving the stack.

2. Description of the Prior Art

The current public awareness of ecological considerations has given a new impetus to the solution of an old problem, namely, the problem of suitably disposing of used reading material, such as newspapers, for example. For many years, the newspaper reader disposed of old newspapers merely by placing them with the household trash or garbage. Recently, the desirability of recycling paper products has become apparent to the general public, with the result that newspapers are now separately stored by the reader and subsequently bound into bales of managable size for sale or donation to organizations which reprocess the paper. This practice, however, has given rise to problems for the reader. For example, the reader must now provide a place in his or her home where the newspapers can be stored and when the stack of used reading material reaches a physically managable size, the stack must be tied by baling string into a bale for transportation to the paper recycling organizations.

A number of different devices have been proposed to assist the reader in disposing of unwanted newspapers and other reading material. For example, a substantially closed-sided, stackable storage container has been developed which has a number of intersecting grooves formed in the sides and bottom of the container to permit lengths of baling string to be laid in the grooves before the papers are placed in the container. This arrangement may present an unsightly appearance, however, because the baling string must be placed in the grooves before the papers are placed in the container for storage with the result that the ends of the string are left dangling until the stack of papers reaches the correct size for baling. Furthermore, after the stack of newspapers is baled, it is often difficult for the user to reach the bottom of the stack to lift it out of the container, since insufficient room may be present between the closed sides of the device and the stack of newspapers to permit insertion of human hands. In other arrangements, the bottom and sides of the paper storage container consist only of metal or plastic arms which provide only limited support for the stack. These arrangements utilize horizontal openings in the arms to permit insertion of the baling string under the stack. These devices, however, require the user to lift the stacked newspapers to move the lengths of baling string under the stack of papers to the correct locations for tying which may require substantial physical strength on the part of the user. Furthermore, since the bottom of the storage container consists only of metal or plastic arms which support the stack of papers, the corners of the stacked papers droop because no physical support is present at these points, with the result, that an unsightly appearance is presented in the home of the user. Accordingly, it is believed apparent that a need exists for newspaper storage and baling apparatus which not only stores the newspapers in a neat well-defined stack but which also permits the stacked papers to be baled without the necessity of physically lifting or moving the heavy stack of papers.

SUMMARY OF THE INVENTION

It is an object of this invention to provide apparatus for storing and baling newspapers and the like which permits the papers to be stored in a neat, well-defined stack and which permits the baling operation to take place without physical movement or lifting of the stack of papers.

It is a further object of this invention to provide apparatus for storing and baling newspapers and the like which utilizes a novel, self-locking arrangement for securing the legs of the apparatus to the paper storage and baling shelves thereof to permit the apparatus to be easily assembled and disassembled.

It is a still further object of this invention to provide apparatus for storing and baling newspapers and the like which provides a continuous, visible indication of the approximate weight of the stacked newspapers.

It is an additional object of this invention to provide apparatus for storing and baling newspapers and the like which is mobile for easy positioning and movement of the baled papers and which also provides an auxiliary storage shelf for magazines and other reading material.

It is another object of this invention to provide apparatus for storing and baling newspapers and the like which is easily manufactured and which permits each bale of papers to be tied with either one, two or three lateral ties per bale.

Briefly, the apparatus of the invention comprises an elongated threading rod having a handle at one end thereof and a notch at the other end thereof for holding one end of a length of baling string. The apparatus also includes a horizontally-disposed imperforate rectangular shelf for storing and baling newspapers and the like on the top side thereof. The shelf has longitudinally-extending groove means on the top side extending the length of the shelf substantially along the center line thereof and laterally-extending groove means on the top side extending the width of the shelf substantially perpendicular to the longitudinally-extending groove means. Each of the groove means has a cross-sectional area of sufficient size to permit the threading rod to be inserted in the groove means with a stack of newspapers and the like abutting the groove means. Support legs are disposed at the corners of the shelf and each of the legs is substantially perpendicular to the plane of the shelf and extends a distance above the top side of the shelf to form an open-sided container for receiving a stack of newspapers and the like. Means are provided for connecting each of the legs to the shelf so that newspapers and the like may be stored on the top side of the shelf and tied into a bale with baling string passed through the groove means with the threading rod. Each of the legs comprises first and second vertically-disposed sections which are perpendicular to each other and abut the corner of the shelf associated therewith. The connecting means for each leg comprises a downwardly-extending male member on the bottom side of the corner of the shelf associated therewith. The male member has two vertically-disposed sections which are perpendicular to each other. An upwardly-extending female member is on the sections of the leg associated with that shelf corner. The female member has two vertically-disposed pockets which are perpendicular to each other and adapted to receive the sections of the male member therein, so that the legs may be easily assembled to and disassembled from the shelf. When the laterally-extending groove means comprises two spaced-apart grooves, two lateral ties per bale may be made. When the laterally-extending groove means comprises three spaced-apart grooves, either one, two or three lateral ties per bale may be made.

The nature of the invention and other objects and additional advantages thereof will be more readily understood by those skilled in the art after consideration of the following detailed description taken in conjunction with the accompanying drawings.

BRIEF DESCRIPTION OF THE DRAWINGS

In the drawings:

FIG. 3 is a side elevational view of one support leg of the apparatus looking at the inside of the leg;

FIG. 4 is a perspective view on an enlarged scale of the female member of each of the connecting means which are employed to connect the support legs to the shelves of the apparatus;

FIG. 5 is a perspective view on an enlarged scale of the male member of each of the connecting means which are employed to connect the legs to the shelves;

FIG. 6 is a fragmentary top plan view on an enlarged scale of the baling shelf of the apparatus showing the threading rod inserting a length of baling string in the longitudinal groove means with the threading rod foreshortened for convenience of illustration; and FIG. 7 is a sectional view taken along the line 7—7 of FIG. 6 of the drawings showing the longitudinal groove means with the threading rod and baling string inserted therein and with a stack of papers thereon.

DESCRIPTION OF THE PREFERRED EMBODIMENT OF THE INVENTION

Figure 1:
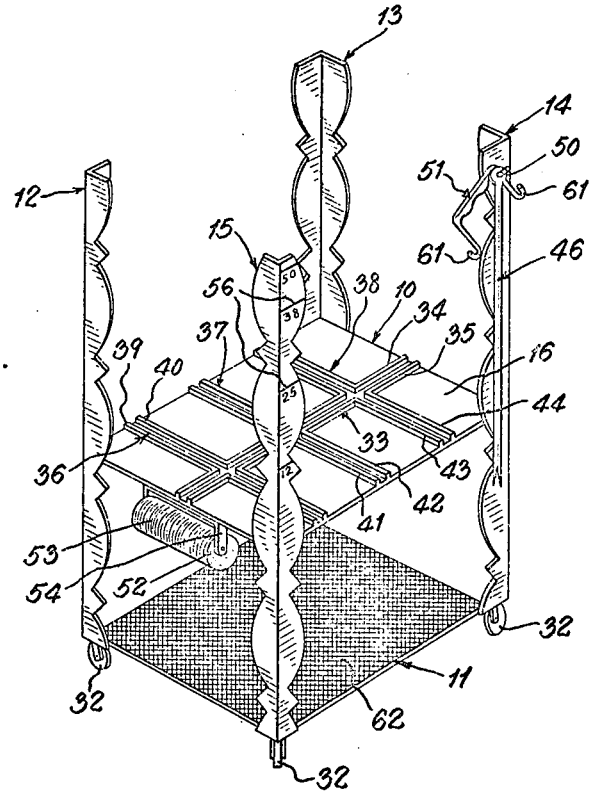
FIG. 1 is a perspective view of apparatus for storing and baling newspapers and the like constructed in accordance with the teachings of the present invention.
Figure 2:
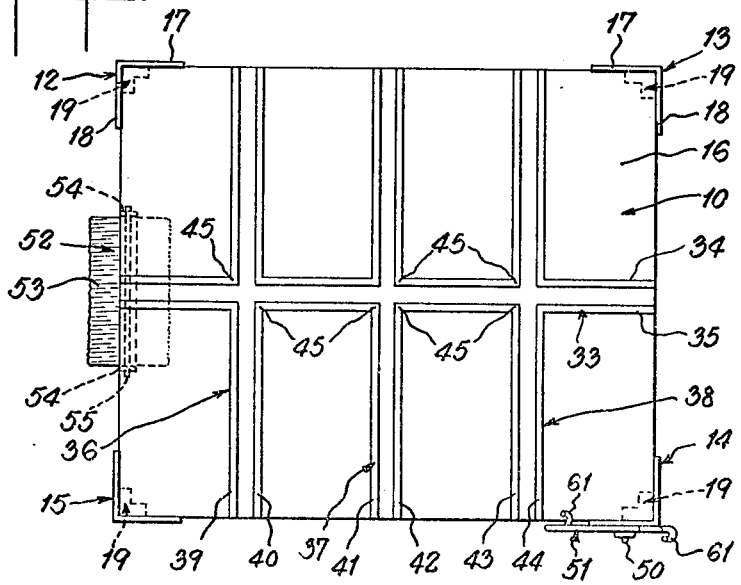
FIG. 2 is a top plan view of the apparatus of FIG. 1.

Referring now to FIGS. 1 and 2 of the drawings, there is shown apparatus for storing and baling newspapers and the like constructed in accordance with the teachings of the present invention. The apparatus comprises an imperforate, rectangular baling shelf, indicated generally as 10, which is horizontally-disposed and spaced a distance from and above a storage shelf, indicated generally as 11. The shelves 10 and 11 are secured to and supported by four support legs, indicated generally as 12, 13, 14 and 15, which are disposed at the corners of each of the shelves. Each of the legs is substantially perpendicular to the planes of the shelves 10 and 11 and extends a distance above the top side 16 of the baling shelf 10, so that the side 16 of the shelf cooperates with the legs 12 through 15 to form an open-sided container which is adapted to receive a stack (not shown) of newspapers and the like.

As seen in FIG. 3 of the drawings, each of the support legs 12 through 15 comprises a first vertically-disposed section 17 and a second vertically-disposed section 18 which are perpendicular to each other and which abut the adjacent corner of the shelf to which the leg is connected. Each leg is connected to the adjacent corner of the shelf by unique, self-locking connecting means, indicated generally as 19. The connecting means 19 each have an upwardly-extending female member, indicated generally as 20, which is shown in FIG. 4 of the drawings, and a downwardly-extending male member, indicated generally as 21, which is shown in FIG. 5 of the drawings. As seen in FIG. 4, the female member 20 comprises two triangular sections 22 and 23 which are perpendicular to each other and which are mounted on the support leg sections 17 and 18. The female member section 22 is cut away at 24 to form a triangular pocket 25 between the member section 22 and the support leg section 18. In a similar fashion, the female member section 23 is cut away at 26 to form a triangular pocket 27 between the member section 23 and the support leg section 17. The pockets 25 and 27 are joined at the corner 28 of the perpendicular support leg sections 17 and 18 and are perpendicular to each other. As seen in FIG. 5, the male member 21 of the connecting means 19 has two, downwardly-extending triangular sections 29 and 30 which are mounted on the bottom side 31 of the shelf 10. The male member sections 29 and 30 are vertically-disposed and are perpendicular to each other at the corner of the shelf. The sections 29 and 30 are given a size and shape so that they will respectively fit into the pockets 25 and 27 of the female connecting member 20 with a sliding fit.

By virtue of this arrangement, each corner of the shelf 10 is provided with a male member 21 which is seated in the pockets 25 and 27 of the female connecting member 20 on the adjacent support leg. Since both the sections of the male member 21 and the pockets of the female member 20 are tapered, the weight of newspapers and the like on the shelf tends to force the two members into close engagement and the corners of the shelf 10 are forced against the sections 17 and 18 of each of the support legs. The connecting means 19 for the lower shelf 11 are constructed in the same manner except that the male members 21 depend from the shelf 11. Accordingly, as newspapers or other reading material are stacked on the shelves 10 and 11, the shelf-locking feature of the connecting means 19 assures a mechanically strong and rigid connection between the shelves and the legs of the apparatus. The unique connecting means employed also permit the apparatus to be easily assembled and disassembled as required. In order to provide for mobility of the assembled apparatus, a caster 32 is provided at the bottom of each of the support legs 12 through 15 as seen in FIGS. 1 and 3 of the drawings. The casters 32 may be swivally mounted on each leg by seating the shank or shaft (not shown) of the caster into a hole (not shown) formed in the female connecting members 20 which support the bottom or storage shelf 11 in accordance with known techniques.

Referring again to FIGS. 1 and 2 of the drawings, it is seen that the top or baling shelf 10 is provided with longitudinally-extending groove means, indicated generally as 33, on the upper side 16 of that shelf. The groove means 33 are formed by substantially parallel strips 34 and 35 which are disposed on and project above side 16 of the shelf. In a similar fashion, three laterally-extending groove means, indicated generally as 36, 37 and 38 are also provided on the side 16 of the shelf 10. Groove means 36 is formed by substantially parallel strips 39 and 40, while groove means 37 is formed by similarly disposed strips 41 and 42. Finally, groove means 38 is formed by the strips 43 and 44. As seen in FIG. 2 of the drawings, each pair of strips which form each of the groove means are broken away at the points 45 where they intersect the strips of another groove means, so that each of the four groove means on the shelf side 16 provides an open groove for the full length or width of the shelf as the case may be. Each of the groove means is so proportioned as to have cross-sectional area of sufficient size to permit a threading rod, indicating generally as 46, to be inserted in and move easily through the groove when a stack of newspapers is placed on the baling shelf 10.

The threading rod 46 is shown in FIGS. 1 and 6 of the drawings as comprising a cylindrical rod 47 having a loop or handle 48 formed at one end thereof and a notch 49 formed at the other end thereof. The threading rod 46 has a length which is sufficient to insure that the notch 49 will project out of one end of the longitudinal groove means 33 when the rod is inserted in the other end of that groove means. The loop 48 at the end of the threading rod 46 serves not only as a handle to permit the threading rod to be easily inserted in and withdrawn from the groove means but also serves as a hanger which permits the rod to be hung for storage on a peg 50 which is mounted on the support leg 14 as shown in FIG. 1 of the drawings. The peg 50 also serves to store a bale carrying handle, indicated generally as 51, the function of which will be described hereinafter.

As seen in FIGS. 1 and 2 of the drawings, the baling shelf 10 is provided with a holder, indicated generally as 52, for a roll 53 of baling string. The holder 52 has a pair of spaced-apart and downwardly-extending lugs or ears 54 which are secured to the underside 31 of the shelf 10. The lugs 54 are each provided with an aperture which receives an end of a shaft or spool 55 shown in dotted outline in FIG. 2 of the drawings. The lugs 54 are preferably formed of a material, such as a suitable metal or plastic, which has some flexibility and resiliency, so that the lugs may be spread apart to receive the ends of the shaft 55 in the apertures formed in the lugs to permit the roll 53 of baling twine to be inserted in and removed from the holder.

In operation, the user of the apparatus places each day's newspapers or other reading material in the open-sided container formed by the top side 16 of the shelf 10 and the upwardly-extending portions of the support legs 12 through 15. As the papers are deposited on the shelf 10, the stack will grow in height until it reaches a size that the user can physically handle without difficulty. Since the weight of the stack of newspapers is substantially proportional to the height of the stack for newspapers of approximately the same size, support leg 15 of the apparatus is graduated with a vertically-extending scale 56 which expresses the height of the stack of newspapers in terms of the approximate weight of the stack. By this means, the user is able to ascertain when the stack reaches the maximum weight which the user can easily handle. When this limit is reached, the stack of papers is ready for baling and the user takes the free end 57 of the baling string 58 from the roll 53 and inserts it in the notch 49 in the end of the threading rod. The rod may then be inserted in the longitudinally-extending groove means 33, for example, as shown in FIGS. 6 and 7 of the drawings. As seen in FIG. 7, the bottom 59 of the stack 60 of newspapers rests on the tops of the strips forming the groove means, so that the threading rod with the free end 57 of the baling string may be easily pushed from one end of the groove means to the other. When the threading rod reaches the end of the groove means, the user grasps the end 57 of the baling string and the threading rod is removed from the groove. The user then makes a longitudinal tie on the stack of newspapers and cuts the string.

If the user decides to employ only a single lateral or cross tie, the threading rod is provided with a new end of the baling string from the roll 53 and the rod is inserted in the groove means 37 which is approximately located on the center line of the shelf side 16. When the notched end of the threading rod with the free end of the baling string projects beyond the end of the groove means 37, the baling string is held by the user and the threading rod is withdrawn whereupon the user makes the single lateral tie and again cuts the string. If the user wishes to make two lateral ties, the groove means 36 and 38 are utilized since each is located approximately one half the distance from the groove means 37 to the end of the shelf 10. The threading rod is then employed for each of the groove means 36 and 38 and the two lateral ties are made in the same manner. Accordingly, the baling operation may be carried out by using a single longitudinal tie and either one, two or three lateral ties per bale. If the user wishes to employ a single length of baling string to make all of the ties without cutting the string after each tie, the free end of the string is pushed through all of the groove means in succession without cutting and the string is looped at the points of intersection of the longitudinal tie and the lateral ties. It will be noted that during the baling operation it is not necessary for the user to physically move the stack of papers in order to perform any of the tying operations. Furthermore, prior to the baling operation, the papers are stored in a neat, well-defined stack without unsightly drooping corners since the shelf 10 provides full support for the corners of the stacked papers.

After the baling operation has been completed, the bale of newspapers may be left in the apparatus and the apparatus may be wheeled to the paper storage area before the bale is removed so that the user is spared the trouble of carrying the bale this distance. The bale carrying handle 51, which is shown in FIG. 1 of the drawings, may be utilized to lift the bale out of the apparatus by hooking the curved ends 61 of the handle on the baling string securing the bale. The bottom or storage shelf 11 of the apparatus may be utilized to store other types of reading materials, such as magazines or brochures, for example. Since the paper stock on which magazines are printed usually has a glossy and somewhat "slippery" surface, the top side 62 of the storage shelf 11 may be provided with striations or other surface irregularities as shown in FIG. 1 of the drawings so that the magazines will not slide off the shelf when the apparatus is moved from one location to another.

The apparatus of the invention may be made of wood, metal or any suitable plastic. If the shelf 10 is made of wood, the strips 34 and 35 which form the longitudinal groove means 33 and the strips 39 through 44 which form the three laterally-extending groove means may also be made of wood and secured by means, such as nailing or glueing, for example, to the surface 16 of the shelf. If the shelf 10 is made of a plastic, the entire shelf may be molded or cast as a single part and the strips will then form an integral part of the surface 16 of the shelf. The groove means may also be formed by cutting away the surface 16 of the shelf so that the grooves lie below the level of the side 16 of the shelf and the stack of newspapers rests on the entire surface of the shelf. The holder 52 for the roll of baling string may be separately made and affixed by any suitable means, such as screws or nails, for example, to the underside 31 of the shelf 10 or, if desired, the lugs 54 of the holder may form an integral part of the shelf 10 when the shelf is made of a suitable plastic or metal. The support legs 12 through 15, the storage shelf 11 and the threading rod 46 may also be fabricated of wood, metal or plastic. If a suitable plastic is employed, the female connecting member 20 may be cast as an integral part of the support leg and the male connecting member 21 may be cast as an integral part of the shelves 10 and 11. Accordingly, it is apparent that the apparatus of the invention may be economically manufactured with a minimum number of operations needed to produce the component parts.

It is believed apparent that many changes could be made in the construction and described uses of the foregoing apparatus and many seemingly different embodiments of the invention could be constructed without departing from the scope thereof. Accordingly, it is intended that all matter contained in the above description or shown in the accompanying drawings shall be interpreted as illustrative and not in a limiting sense.

What is claimed is:

1. Apparatus for storing and baling newspapers and the like comprising an elongated threading rod having
- a handle at one end thereof, and
- a notch at the other end thereof for holding one end of a length of baling string;

a horizontally-disposed imperforate rectangular shelf for storing and baling newspapers and the like on the top side thereof, said shelf having
- longitudinally-extending groove means on said top side of the shelf extending the length of the shelf substantially along the center line thereof, and
- laterally-extending groove means on said top side of the shelf extending the width of the shelf substantially perpendicular to said longitudinally-extending groove means,
- each of said groove means having a cross-sectional area of sufficient size to permit said threading rod to be inserted in the groove means with a stack of newspapers and the like abutting the groove means;

support legs disposed at the corners of said shelf, each of said legs being substantially perpendicular to the plane of said shelf and extending a distance above said top side of the shelf to form an open-sided container for receiving a stack of newspapers and the like, each of said legs having first and second vertically-disposed sections which are perpendicular to each other and abut the corner of the shelf associated therewith; and connecting means for connecting each of said legs to said shelf, the connecting means for each leg comprising
- a downwardly-extending male member on the bottom side of the corner of the shelf associated therewith, said male member having two vertically-disposed sections which are perpendicular to each other, and
- an upwardly-extending female member on the sections of the leg associated therewith, said female member having two vertically-disposed pockets which are perpendicular to each other and adapted to receive the sections of said male member therein, whereby newspapers and the like may be stored on said top side of the shelf and tied into a bale with baling string passed through said groove means with said threading rod.

2. Apparatus as claimed in claim 1 wherein each of said groove means comprises a pair of substantially parallel strips disposed on and projecting above said top side of the shelf.

3. Apparatus as claimed in claim 1 wherein said longitudinally-extending groove means comprises a single groove to permit a single longitudinal tie per bale, and said laterally-extending groove means comprises two spaced-apart grooves to permit two lateral ties per bale.

4. Apparatus as claimed in claim 1 wherein said longitudinally-extending groove means comprises a single groove to permit a single longitudinal tie per bale, and said laterally-extending groove means comprises three spaced-apart grooves to permit either one, two or three lateral ties per bale.

5. Apparatus as claimed in claim 1 wherein at least one of said legs has a vertically-extending scale thereon expressing the heights of stacks of newspapers and the like on said shelf as approximate weights of the stacks.

6. Apparatus as claimed in claim 1 wherein the sections of said male member are tapered, and the pockets of said female member are correspondingly tapered to facilitate engagement of said members, whereby the weight of a stack of newspapers and the like on said shelf tends to force said members into closer engagement with each other to provide a mechanically-rigid connection between each leg and the corner of the shelf associated therewith.

7. Apparatus as claimed in claim 6 further comprising a second horizontally-disposed rectangular shelf spaced a distance from and below said first-named shelf for storing magazines and the like thereon.

8. Apparatus as claimed in claim 7 wherein said threading rod handle is a loop formed at said one end of the rod, and a peg adapted to receive said threading rod loop thereon is provided on one of said legs for storage of said rod.

9. Apparatus as claimed in claim 8 further comprising a baling string holder on the bottom side of said first-named shelf, said holder comprising
- a horizontally-disposed shaft adapted to receive a roll of baling string thereon, and
- a pair of spaced-apart downwardly-extending lugs on the bottom side of said first-named shelf, each of said lugs having an aperture formed therein to receive an end of said shaft and being formed of a flexible resilient material to permit the lugs to be spread apart for insertion and removal of said shaft.

10. Apparatus as claimed in claim 9 wherein a caster is disposed on the bottom of each of said legs to permit the apparatus to be rolled about, and the top side of said second shelf is serrated to prevent slippage of magazines and the like thereof.

* * * * *